US006203136B1

(12) United States Patent
Takahashi et al.

(10) Patent No.: US 6,203,136 B1
(45) **Date of Patent: *Mar. 20, 2001**

(54) PRINT HEAD CAPPING DEVICE HAVING AN INCLINED CAP

(75) Inventors: Nobuhito Takahashi; Seiji Mochizuki; Masahiro Isono; Shigenori Fukasawa; Atsushi Kobayashi; Kazuhisa Kawakami, all of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/792,112

(22) Filed: Jan. 31, 1997

Related U.S. Application Data

(63) Continuation of application No. 08/653,483, filed on May 24, 1996, now abandoned.

(30) Foreign Application Priority Data

May 25, 1995 (JP) ..... 7-151011
Dec. 19, 1995 (JP) ..... 7-349221

(51) Int. Cl.[7] ..... B41J 2/165
(52) U.S. Cl. ..... 347/32; 347/29
(58) Field of Search ..... 347/29–32

(56) References Cited

U.S. PATENT DOCUMENTS 4,024,548 * 5/1977 Alonso et al. ..... 347/90
5,055,856 * 10/1991 Tomii et al. ..... 347/30
5,216,449 6/1993 English ..... 347/29
5,280,299 * 1/1994 Saikawa et al. ..... 345/86
5,382,969 * 1/1995 Mochizuki et al. ..... 347/23
5,426,456 * 6/1995 Kuelzer et al. ..... 347/29
5,440,331 * 8/1995 Grange ..... 347/32
5,561,448 * 10/1996 Kaneko et al. ..... 347/29

FOREIGN PATENT DOCUMENTS

004035507 * 6/1991 (DE) ..... 400/701
WO 91/10570 7/1991 (EP) .
576 033 * 12/1993 (EP) ..... 347/32
2024147 * 1/1990 (JP) ..... 347/31
6-8457 * 1/1994 (JP) ..... 347/29

* cited by examiner

*Primary Examiner*—N. Le
*Assistant Examiner*—Hai C. Pham
(74) *Attorney, Agent, or Firm*—Sughrue, Mion, Zinn, Macpeak & Seas, PLLC

(57) ABSTRACT

On a slider which is pressed by a carriage to follow the movement the carriage while moving up and down on a base in accordance with the movement of the carriage, a cap is provided swingably through a support frame urged against a recording head by a spring or the like so that only one of its corners projects out at the time of non-capping. The cap moving up in accordance with the movement of the carriage, first, comes into contact with a nozzle plate of the recording head, and then expands the contact region gradually until it contacts with the whole of the nozzle plate. Therefore, pressure is concentrated in the contact free region partially so that the cap becomes familiar to the nozzle plate from its one corner and expands the contact region to make sealing finally.

25 Claims, 20 Drawing Sheets

PRINT HEAD CAPPING DEVICE HAVING AN INCLINED CAP

This application is a continuation of Ser. No. 08/653,483, filed May 24, 1996, now abandoned.

BACKGROUND OF THE INVENTION

1. Field of the Invention

The present invention relates to a capping device suitable for a recording apparatus provided with an ink jet recording head movable in the width direction of a recording paper and for ejecting ink drops onto the recording paper in accordance with printing data so as to form an image thereon.

2. Description of the Prior Art

An ink jet recording apparatus ejects ink pressurized in a pressure generating chamber onto a recording paper from a nozzle as ink drops so as to record printing data. This type of recording apparatus has the following problems, that is, increase of viscosity of the ink and solidification of the ink caused by the evaporation of a solvent from the opening of the nozzle, adhesion of dusts, mixing of bubbles in the ink and so on.

Therefore, such an ink jet recording apparatus usually has a capping means for sealing nozzle openings of a recording head at the time of not printing, and a cleaning means for cleaning a nozzle plate in accordance with necessity.

For example, in Japanese Patent Publication No. Hei. 1-125239, there is provided a sled to be pushed out and moved by a carriage which has moved to its home position. The sled moves to a nozzle opening face of a recording head along an inclined guide face provided in a frame, and a rubber cap provided in the surface of the sled is pressed onto the recording head so as to seal nozzle openings.

In addition, in Japanese Patent Publication No. Hei. 2-13910, two arms constituting a parallelogram link is interposed between a frame and a cap as means for pressing the cap against a recording head so as to move the cap by means of a carriage not only horizontally but also toward the recording head.

In these capping means, the quantity of vertical movement is determined by the inclined guide face on the frame or parallelogram link. Accordingly, in the case where more or less scattering arises in the distance between the running course of the carriage and the frame due to an error on finishing or assembling parts, or in the case where the distance between a platen and the recording head is readjusted for printing on thick printing paper such as envelope, the distance between the recording head and the cap is changed and therefore the sealing effect of the nozzle openings depends on the elastic deformation of the cap itself. This especially causes no particular effect if the sealing face is small, but a gap is apt to arise in the case of sealing an ink jet recording head such as a color printing recording head, which is large enough to have a number of arrays of nozzle openings, so that reliable sealing cannot be expected.

In addition, as disclosed in Japanese Patent Publication No. Sho. 59-103762, an inverted-L head protective cover is pivoted at a point on a home position, and the protective cover is rotated by a carriage moved back to the home position, so as to press a cap provided at one end of the protective cover against an ink jet recording head.

According to this capping device, the rotation quantity of the protective cover changes in accordance with the distance to the nozzle face, so that it is possible to seal the recording head positively even in a recording apparatus where the distance between a platen and a printing head changes, but the moving direction of the recording head is different from the moving direction of the cap, so that there is such a problem that relative movement between the both causes unnecessary deformation in the cap so that the cap is apt to be fatigued or damaged.

In order to solve such a problem, as disclosed in Japanese Patent Publication No. Hei. 6-8460, there is provided a capping device comprising a cap disposed outside a printing region and pressed by a recording head or a carriage holding the recording head so as to move between a non-capping position and a capping position, and a cum surface and a cum follower for moving the cap toward a nozzle plate of the recording head when the recording head moves from the non-capping position to the capping position. According to this configuration, it is surely possible to contact the cap with the nozzle plate elastically and seal the cap only by moving the carriage positively.

However, a color-printing ink jet recording head where the arrays of the nozzle openings for ejecting ink of three colors are integrated in a single nozzle plate has been put into practical use, and the length in the printing direction of a recording head has been expanded about 6 times as large as that of a recording head for ejecting a single-color ink. As a result, there has arisen a problem of reduction in the sealing performance, and so on.

SUMMARY OF THE INVENTION

Taking the above situations into consideration, an object of the present invention is to provide a capping device suitable for a recording apparatus using an ink jet recording head such as a color-printing ink jet recording head or the like having a large aspect ratio.

According to the present invention, there is provided a capping device for an ink jet recording head, comprising: a base; an arm swingably and slidably supported by the base; a slider which is swingably connected to the arm, the slider approaching and separating from the recording head while moving up and down; a cap disposed on the slider; and an elastic member which urges the cap for the recording head side in such a manner that only one corner of the cap projects for the recording head at the time of non-capping.

Since the cap moved up in accordance with the movement of the carriage contacts with the recording head so as to spread the contact region gradually from one of its corners, the pressure is collected into the contact free place partially so that the cap is made familiar to the recording head gradually from one corner so as to expand and seal the contact region.

DETAILED DESCRIPTION OF THE PREFERRED EMBODIMENTS

The present invention will be described in detail with reference to the accompanying drawings.

Figure 1:
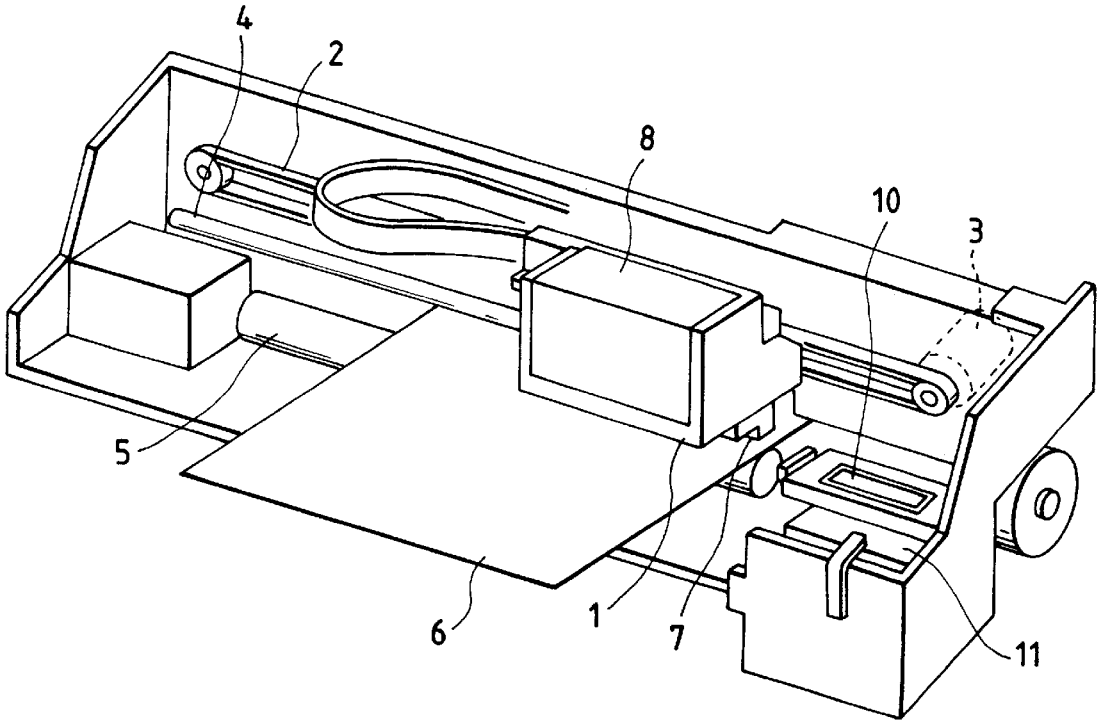
FIG. 1 is a perspective view of an ink jet recording apparatus provided with an ink jet recording head according to the present invention.

FIG. 1 shows an ink jet recording apparatus provided with an ink jet recording head according to the present invention. In FIG. 1, the reference numeral 1 represents a carriage, which is designed to be connected to a motor 3 through a timing belt 2, guided by a guide member 4 and moved in parallel with a platen 5. A color-printing recording head 7 of the carriage 1 is provided opposite to a recording paper 6, and the recording head 7 is supplied with ink from an ink cartridge 8 so as to eject ink drops to the recording paper 6 to perform printing.

The reference numeral 10 represents a capping device according to the present invention. The capping device 10 is connected to a pump unit 11 through a tube and has a size enough to seal the nozzle opening surface of the recording head 7 in one space so as to seal the nozzle opening surface at the time of non-printing. The capping device 10 is supplied with negative pressure from a pump unit 11 at the time of ejecting ability recovery operation so as to forcibly discharge ink from the recording head 7.

Figure 2:
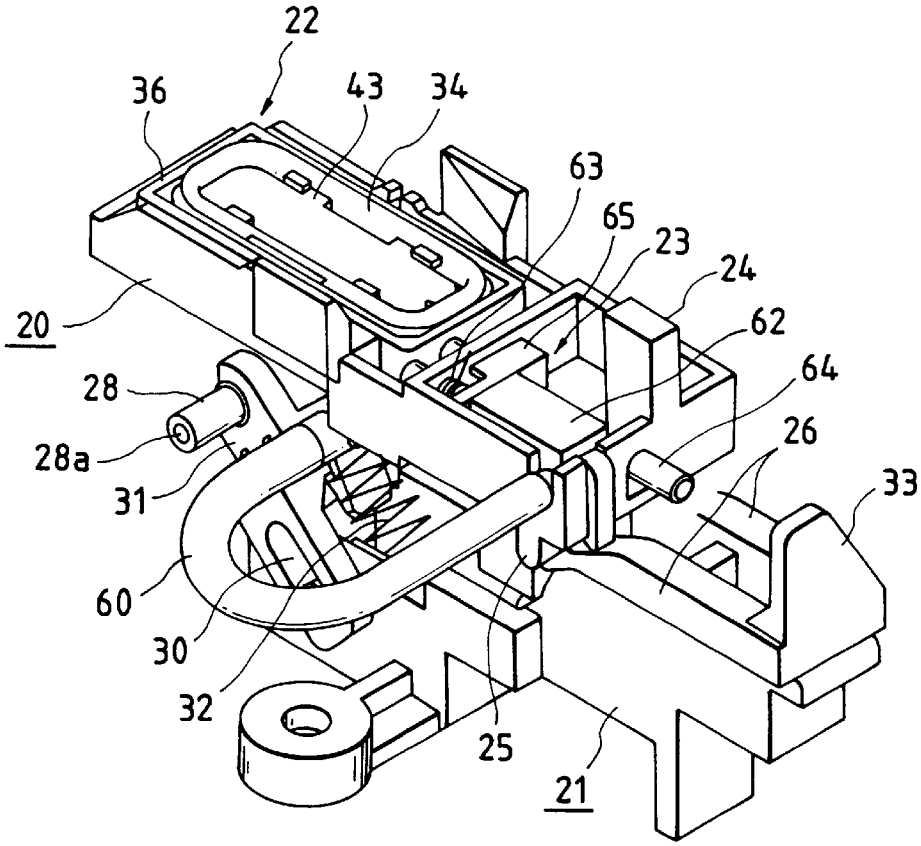
FIG. 2 is a perspective view of a capping device according to a first embodiment of of the present invention.
Figure 3:
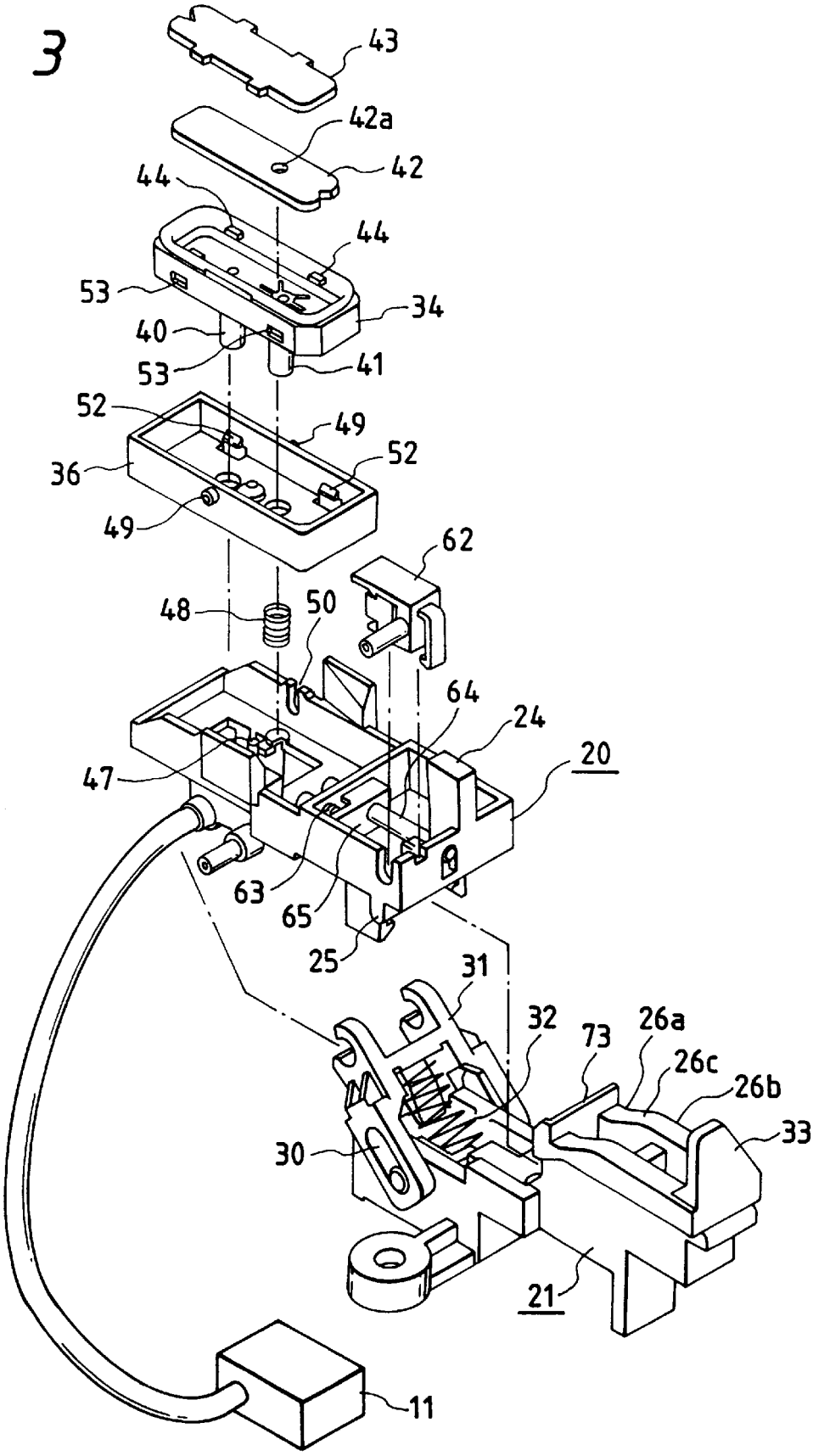
FIG. 3 is an assembly perspective view of the capping device according to the first embodiment.

FIGS. 2 and 3 are a perspective view and a construction perspective view of a capping device according to a first embodiment of the present invention. The reference numeral 20 represents a slider, which is designed to move horizontally, and vertically on a upper surface of a base 21 following the movement of the carriage 1 when the carriage 1 moves to the non-printing region.

A cap member 22 for sealing the nozzle opening surface of the recording head 7 is provided in a half of the upper surface on the side of the printing region (left in the drawings), a valve unit 23 is provided in the other half which will be an outside region (right in the drawings), and a flag piece 24 for contacting with the carriage 1 is further provided at the outermost end.

The slider 20 has a convex portion 25 at the lower end on the outermost end so as to be in contact with a guide surface 26 of the base 21 to slide on the guide surface. The slider 20 also has projection pipes 28 and 29 formed in the side portion of the printing region perpendicularly to the moving direction of the carriage 1. One end of an arm 31 is pivotably supported by the projection pipes 28 and 29, wherein the other end of the arm 31 is supported swingably and slidably by the base 21 through a long opening 30. The printing region sides of the projection pipes 28 and 29 are normally urged upward by a compression spring 32 inserted between the base 21 and the arm 31 so as to take an almost horizontal posture. A communicating hole 28*a* communicating with an ink suction hole 38 of a cap 34, which will be described later, is formed in the projection pipe 28 to engage with the arm 31 so as to serve also as a connection passage.

On the other hand, the guide surface 26 of the base 21 is constituted by a low place 26*a*, a high place 26*b*, and a slope 26*c* connecting these places so that the cap member 22 can occupy two positions, one of which is away from the nozzle plate and the other of which is elastically contacting with the nozzle plate. A stopper 33 for defining a limit point is formed at the outermost end of the high place 26*b*.

Figure 4:
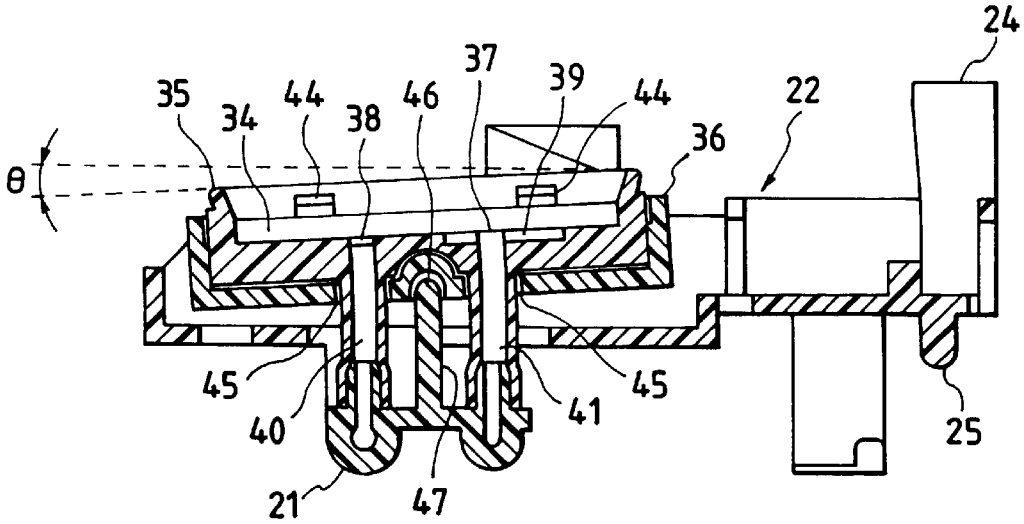
FIG. 4 is a sectional view of the capping device according to the first embodiment.

The cap member 22 is constituted mainly by a cap 34 and a support frame 36 for supporting the cap 34 as shown in FIG. 4. The cap 34 is made of synthetic resin such as rubber having ink resistivity or the like, an atmosphere communication hole 37 and an ink suction hole 38 are provided in a region which is not opposite to the arrays of the nozzle openings, and radial grooves 39 are further provided near the opening of the atmosphere communication hole 37.

These atmosphere communication hole 37 and ink suction hole 38 are connected to the valve unit 23 and the pump unit 11, which will be described later, through conduits 40 and 41 formed integrally with the cap 34 respectively. These conduits 40 and 41 are provided at an interval in the moving direction of the carriage 1, and the conduit 41 on the non-printing region side is longer than the other conduit 40, so that the cap 34 takes such a posture that the printing region side of the cap 34 is made to be a low portion by the elasticity of the conduit 41.

First and second ink absorbing sheets 42 and 43 made of porous material with ink resistivity and ink absorbing property inserted to the cap 34 so as to almost cover the bottom of the cap 34, and the second ink absorbing sheet 43 disposed as an upper layer is fixed by projections 44 and 44 formed in an inner circumferential side portion of the cap 34.

The first ink absorbing sheet 42 disposed as the lower layer is made of such porous material that the small hole diameter thereof is about 50 to 150 μm, while the second ink absorbing sheet 43 disposed as the upper layer is made of such porous material that the small hole diameter thereof is about 200 to 400 μm, and air permeability and ink absorbing property are different between the upper and lower layers. In the ink absorbing sheet 42 on the lower layer side, a small-diameter through hole 42*a* is formed in an opposite region to the atmosphere communication hole 37.

Figure 5A:
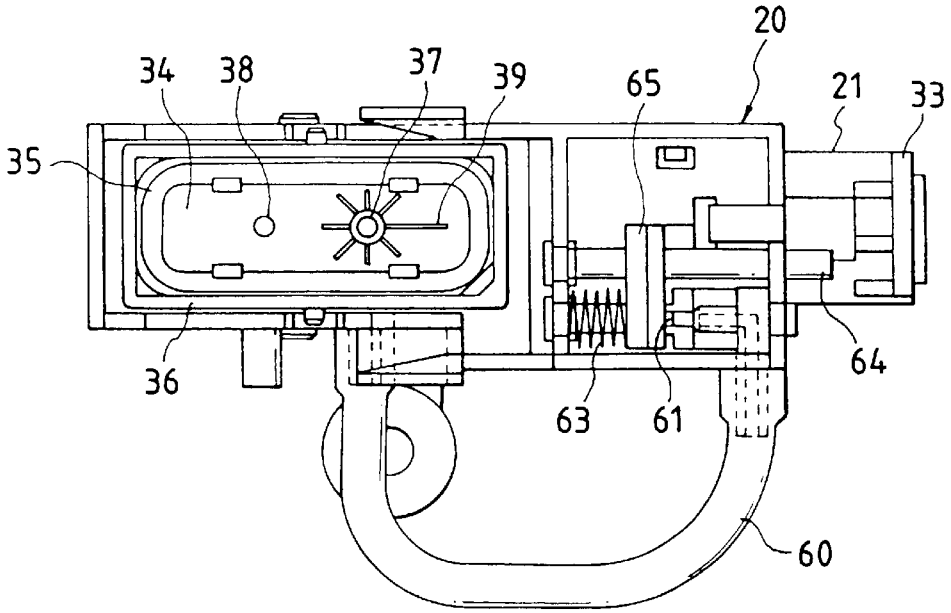
FIGS. 5(*a*) and 5(*b*) are top views of the capping device according to the first embodiment.
Figure 5B:
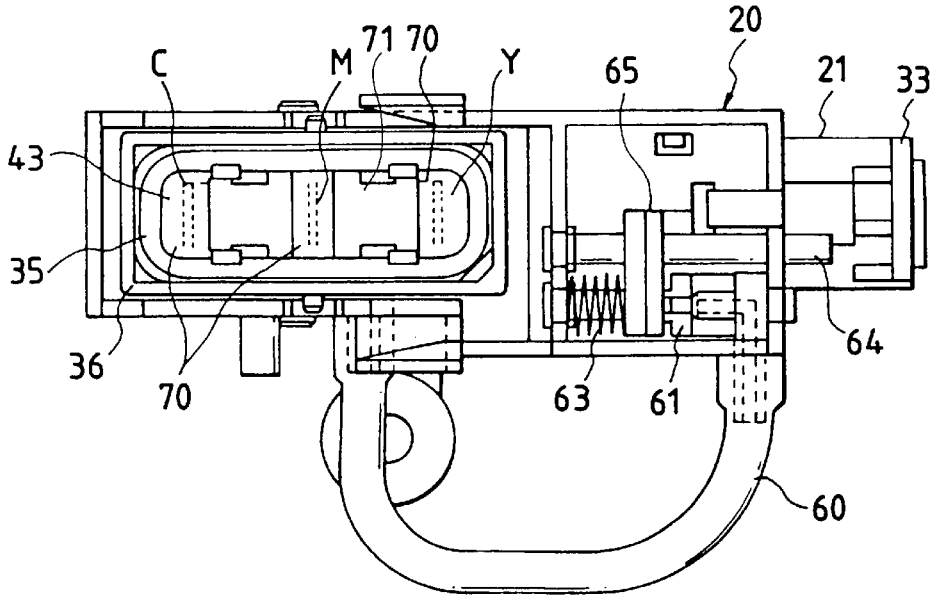

As shown in FIG. 5(*b*), a mask plate 71 having windows 70 for exposing only the regions opposite to the arrays of the nozzle openings C, M and Y is mounted on the surface of the upper layer ink absorbing sheet 43.

Thus, in the ink absorbing sheets 42 and 43, by exposing only the regions opposite to the nozzle openings C, M and Y, it is possible to prevent useless evaporation of ink solvent absorbed in the ink absorbing sheets 42 and 43, while preventing the rebound of ink at the time of flashing.

The support frame 36 has holes 45 and 45 penetrated by the conduits 40 and 41 of the cap 34 in the bottom, and a recessed portion 46 is formed at the center thereof. The recessed portion 46 is fitted to a projection rod 47 extended out of the base 21, and projections 49 and 49 in the side portions are inserted to grooved portions 50 and 50 of the slider 20 while the support frame 36 is pressed elastically by a spring 48 interposed between the cap 34 and the slider 20 so as to be slanted to one side, so that the support frame 36 is attached swingably.

Figure 6A:
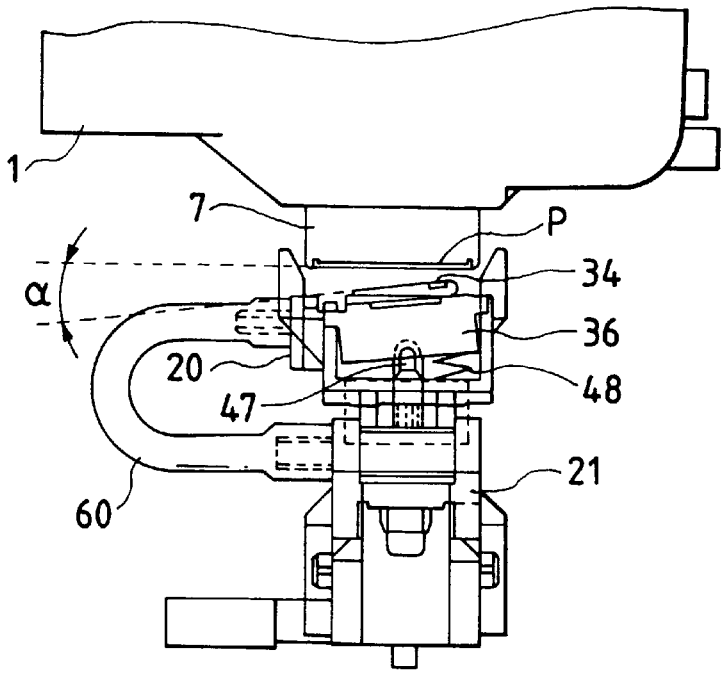
FIGS. 6(*a*) and 6(*b*) are diagrams illustrating postures of a cap with respect to a nozzle plate in the non-capping state and in the capping state.
Figure 6B:
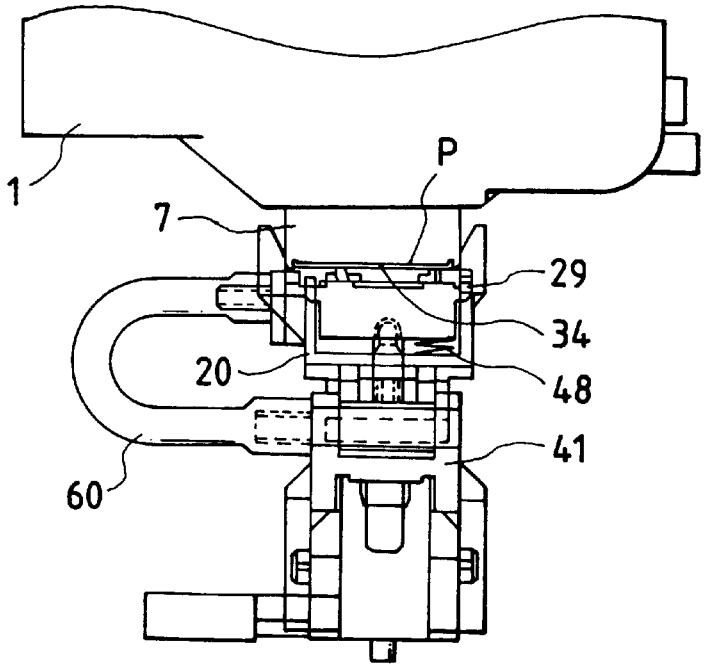
Figure 7A:
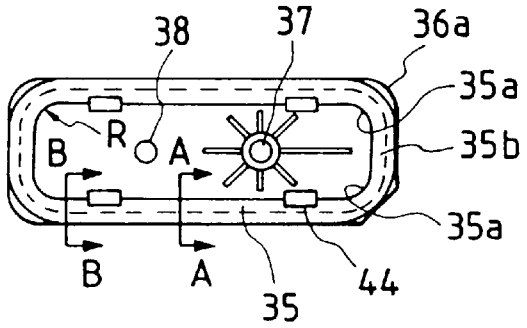
FIGS. 7(*a*) to 7(*c*) are top views of the capping device according to the first embodiment and FIGS. 7(*d*) and 7(*e*) are top views of comparative examples.
Figure 7B:
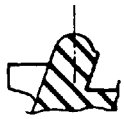
Figure 7C:
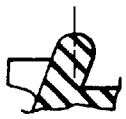
Figure 7D:
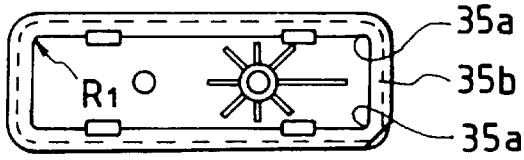
Figure 7E:
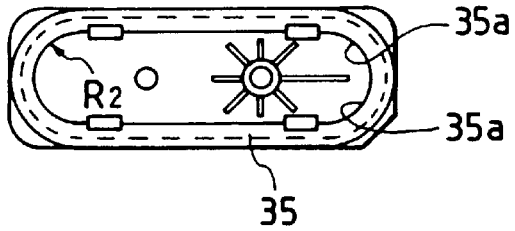

Since the spring 48 is interposed in such a manner that the support frame 36 is slanted to one side, and since the conduit 41 disposed outside is set to be longer than the conduit 40 on the printing region side, the sealed surface of the cap 34 is inclined at an angle α with respect to the plane of a nozzle plate P in the state of non-capping as shown in FIG. 6(*a*), but these spring 48 and conduit 41 are subject to compression in the state of capping so as to be pushed against the nozzle plate P as shown in FIG. 6(*b*), so that the sealed surface can be parallel with the nozzle plate P.

In FIG. 2, the reference numeral 23 represents an above-mentioned valve unit, constituted by a valve seat 62 having an opening 61 connected to the atmosphere communication hole 37 of the cap 34 through a tube 60, and a valve body 65 normally urged to the valve seat side by a spring 63 and having an actuating rod 64 when the slider 20 contacts with the stopper 33, so that the valve unit 23 is designed as a so-called normal close valve, which separates the valve body 65 from the valve seat 62 in accordance with movement of the actuating balance 64.

Since an ink jet recording head has a nozzle plate P having a low rigidity in the surface thereof, there has been a problem that the nozzle plate is damaged if a cap is pressed elastically by a large force. It has been therefore extremely difficult, conventionally, for a single cap to cap a color-printing ink jet recording head having a large aspect ratio.

In the present invention, as shown in FIG. 7(*a*), a draping 35 is formed in the opening surface of the cap 34 so as to reduce the rigidity of the contacting surface, and a straight portion 35*b* is interposed between adjacent corner portions 35*a* so that the straight portion 35*b* is shaped to be almost as large as curvature radius R so as to improve the sealing performance in the corner portions 35*a* and the straight portion 35*b* in short sides, where it is difficult to ensure elasticity.

That is, if curvature radius R1 of the corner portion 35*a* of the cap 34 is made as small as possible to thereby increase the rate of the occupation of the straight portion 35*b* as shown in FIG. 7(*d*), the rigidity of the corner portion 35*a* becomes so large that the sealing performance with the nozzle plate P in this region is reduced.

On the other hand, if curvature radius R2 of the corner portion 35*a* of the draping 35 of the cap 34 is made large enough to form a half-circle with the other adjacent corner portion 35*a* so as to eliminate a straight portion as shown in FIG. 7(*e*), the rigidity of the corner portion 35*a* is so reduced that the sealing performance is reduced.

When the center portion in the longitudinal direction (the region shown by line A—A in FIG. 7(*a*); FIG. 7(*b*)) is made a little thicker than the neighborhood of the corner portion 35*a* (the region shown by line B—B in FIG. 7(*a*); FIG. 7(*c*)) as shown in FIGS. 7(*b*) and 7(*c*), settling caused by the buckling of the center portion at the time of contacting with the nozzle plate can be prevented so that the center portion can contact with the nozzle plate uniformly.

Consequently, when not only the curvature radius of the corner portion 35*a* of the cap 34 is made as large as the length of the straight portion 35*b*, but also the neighborhood of the center portion is formed to be thick on the long sides, there is no fear that no settling arises in any place, and the center portion can contact with the nozzle plate P uniformly with pressure as small as possible by using efficiently the elasticity of the draping 35.

In the first embodiment, the cap 34 is inclined at the angle α with respect to the nozzle plate P as shown in FIG. 6(*a*) when the carriage 1 does not contact with the flag piece 24 of the slider 20.

Figure 8A:
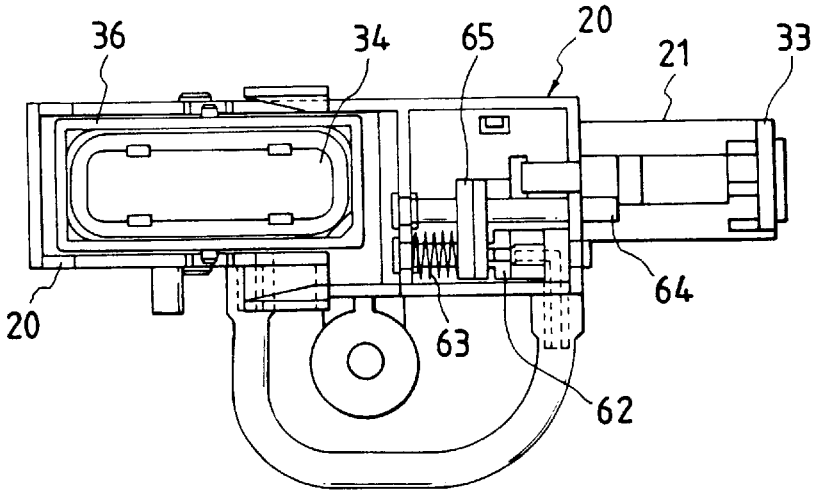
FIGS. 8(*a*) and 8(*b*) are diagrams illustrating the state where a recording head is disposed in a flushing region of a non-printing region.
Figure 8B:
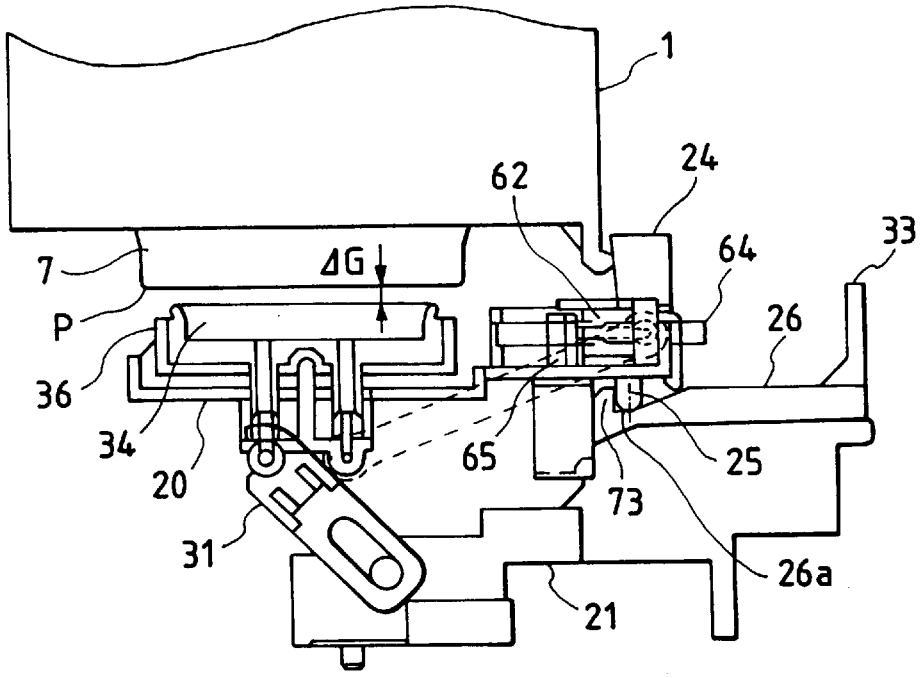

When the carriage 1 moves to the non-printing region and contacts with the flag piece 24 (FIGS. 8(*a*) and 8(*b*)) to move the slider 20, the contact piece 25 of the slider 20 slides on the slope 26*c* of the base 21, so that the cap 34 rises up gradually. In the process of this rising, one end of the cap 34 on the non-printing region side pushed up by the spring 48 and the conduit 41 (FIG. 4) first contacts with the nozzle plate P is pushed by the nozzle plate P to thereby change its posture to be parallel with the nozzle plate gradually, and at last be parallel with the surface of the nozzle plate P to contact therewith tightly as shown in FIG. 6(*b*) and FIG. 9(*b*) when the cap 34 reaches to the position of capping state.

Since the cap moves its contact position with the nozzle plate P partially while expanding the contact region from its one corner of the draping 35 gradually, pressure concentrates into the contact region partially, so that the cap expands the contact region thereof and seals the recording head while being made familiar to the recording head from its one corner. In addition, even if the valve unit 23 is constituted as a normal closed one, the increase of pressure due to the pressure-mounting of the cap 34 is prevented, so that it is possible to prevent the meniscus of the nozzle openings from being backed from the nozzle opening surface.

Figure 9A:
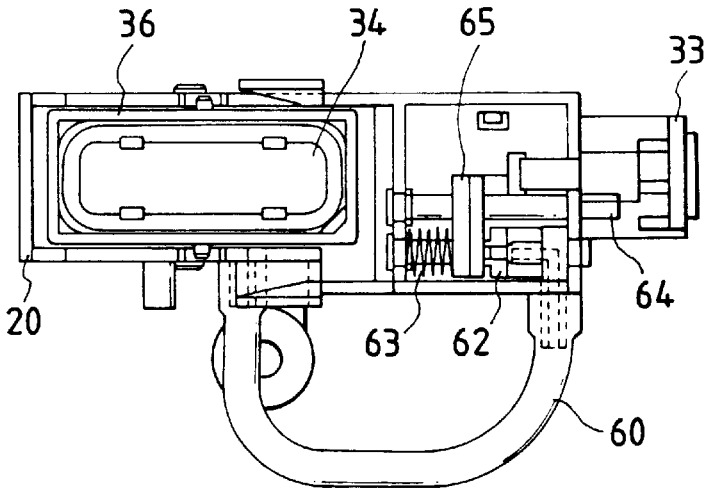
FIGS. 9(*a*) and 9(*b*) are diagrams illustrating the state where the recording head is sealed with a cap.
Figure 9B:
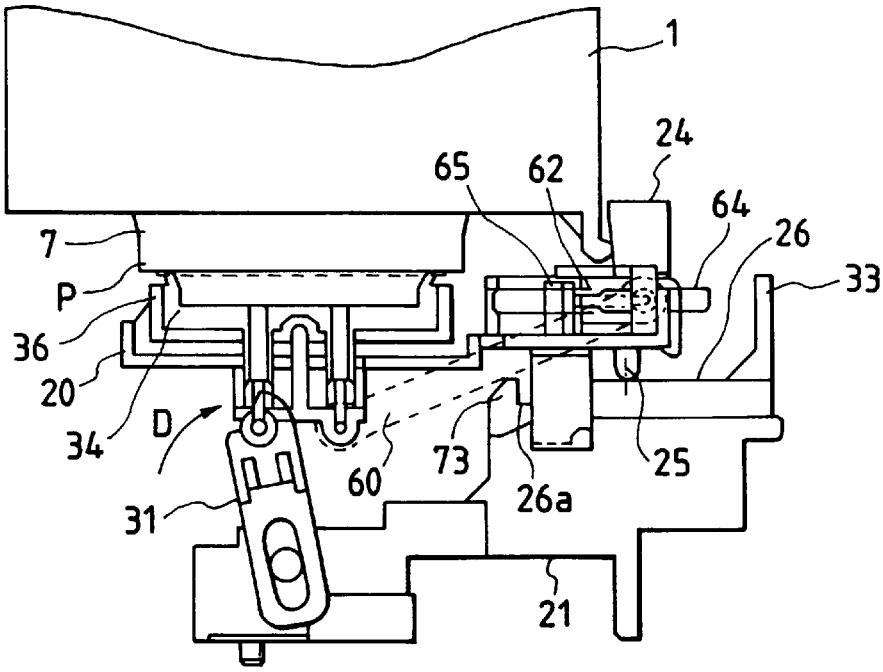

On the other hand, when there arises necessity to forcibly discharge ink from the recording head 7, the pump unit 11 is operated in the state where capping is performed (FIGS. 9(*a*) and 9(*b*)). Consequently, negative pressure is given into the cap 34 through the ink suction hole 38, so that ink drops ejected from the nozzle openings reach the absorbing sheet 43 through the windows 70 of the mask plate 71. Consequently, dust or paper dust adhering near the nozzle openings can be cleaned out, and bubbles in the recording head 7 are also discharged to the cap 34 together with the ink.

Since the ink absorbing sheet 42 disposed as the lower layer is smaller in small hole diameter and richer in flexibility than the ink absorbing sheet 43 as the upper layer, the ink absorbing sheet 42 as the lower layer has a larger capillarity to ink. Therefore, the first ink absorbing sheet 42 as the lower layer makes the ink ejected to the second ink absorbing sheet 43 move toward the lower side by the capillarity, and receives large negative pressure by the ink suction hole 38 so as to contact with the bottom of the cap 34 tightly. It is therefore possible to surely prevent overflow of the ink ejected from the recording head.

Figure 10A:
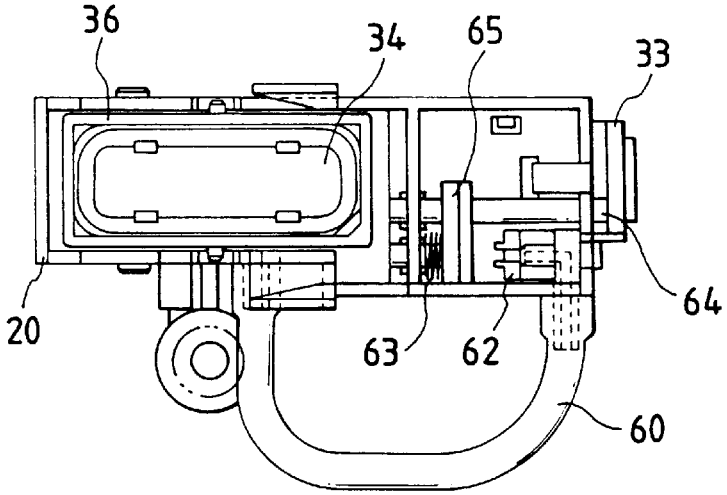
FIGS. 10(*a*) and 10(*b*) are diagrams illustrating the state where the recording head is moved to a suction position.
Figure 10B:
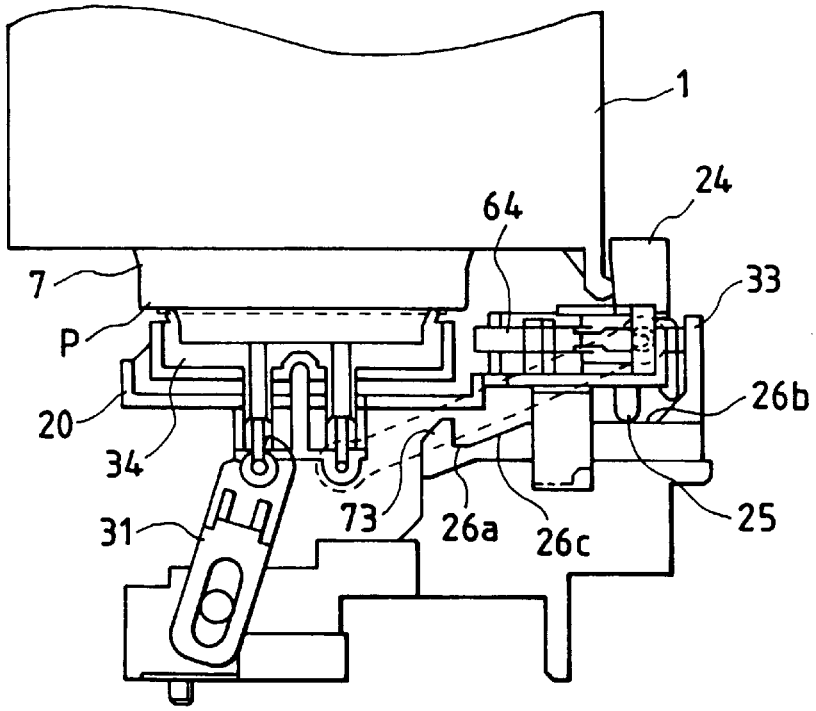

When the carriage 1 is further moved from the capping state (FIGS. 9(*a*) and 9(*b*)) toward the non-printing region (FIGS. 10(*a*) and 10(*b*)), the actuating rod 64 contacts with the stopper 33 to be thereby pushed to the left in the drawing, so that the valve body 65 is separated from the valve seat 62.

In this state, the driving speed of the pump unit 11 is made down to about ½ as high as that in the case where ink is ejected from the nozzle openings so as to perform crawling suction. Accordingly, the air flows in from the atmosphere communication hole 37 of the cap 34, the waste ink of the ink absorbing sheets 42 and 43 is sucked from the ink suction hole 38 gradually, so that the ink absorbed in the ink absorbing sheets 42 and 43 can be sucked continuously, and the flow speed of the air flowing in from the atmosphere communication hole 37 is made as slow as possible, so that the ink included in the ink absorbing sheets 42 and 43 can be discharged from the sheets 42 and 43 without producing bubbles in the ink.

At the stage where the ink included in the ink absorbing sheets 42 and 43 has been sucked, the driving speed of the pump unit 11 is reset to its normal speed so as to discharge ink left in the passages.

Since the radial grooves 39 are provided near the atmosphere communication hole 37, and waste ink sinks in the ink absorbing sheets 42 and 43 so that the air permeability becomes extremely low, the air flowing in from the atmosphere communication hole 37 disperses through the radial grooves 39. Consequently, the waste ink sinking in the ink absorbing sheets 42 and 43 can flow into the cap 34 without producing bubbles in the ink.

That is, in the case where such radial grooves 39 are not provided, the air may flow in from the atmosphere communication hole 37 concentrately, so that the air flow speed in this neighborhood may be extremely large, and the waste ink in this neighborhood blows up so as to produce bubbles in the waste ink, so that dust or paper dust may adhere to the nozzle plate P again.

At the stage where the waste ink in the cap has been discharged, if the pump unit 11 is stopped, and the carriage 1 is moved toward the printing region (FIGS. 9(*a*) and 9(*b*)), the slider 20 moves toward the printing region by the frictional force between the cap 34 and the nozzle plate P, and the actuating rod 64 is separated from the stopper 33 in this process so that the valve body 65 is made to come into contact with the valve seat 62 elastically by means of the spring 63 and the communication between the cap 34 and the air is blocked to bring the inside of the cap 34 to be airtight.

Further, when the carriage 1 moves toward the printing region, the slider 20 moves down along the slope 26*c,* and reaches the low place portion 26*a* (FIGS. 8(*a*) and 8(*b*)). While the slider 20 is moving along the slope 26*c,* the cap 34 moves down gradually, and the cap 34 which is elastically one-sided at its one corner is separated from the nozzle plate P gradually from the corner. Thus, the cap 34 is separated from the nozzle plate P without producing a sudden change in pressure inside the cap 34.

In this state, the cap 34 is separated from the nozzle plate P at a constant gap ΔG, that is, at an enough gap so as not to produce rebound of ink to the nozzle plate P by flushing. Therefore, flushing is executed.

When the carriage 1 further moves toward the printing region, the projection piece 25 of the slider 20 engages with the stopper 73 of the base 21, so that the slider 20 cannot follow the movement of the carriage 1 to the printing region, and the slider 20 stops in the flushable state. When the carriage 1 moves to the non-printing region after the completion of printing, capping is established through the above-mentioned procedure.

Although the slider 20 is moved while contacting with the carriage 1, it is apparent that a similar effect can be obtained even if the recording head 7 is moved while being in contact with the carriage 1.

Figure 11A:
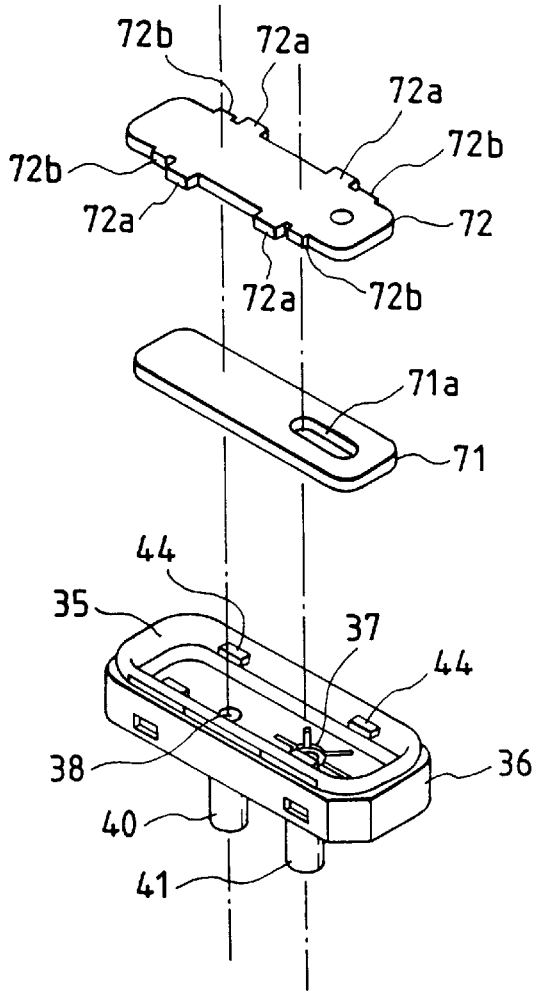
FIGS. 11(*a*) and 11(*b*) are an assembly perspective view and a sectional view of a capping device according to a second embodiment.
Figure 11B:
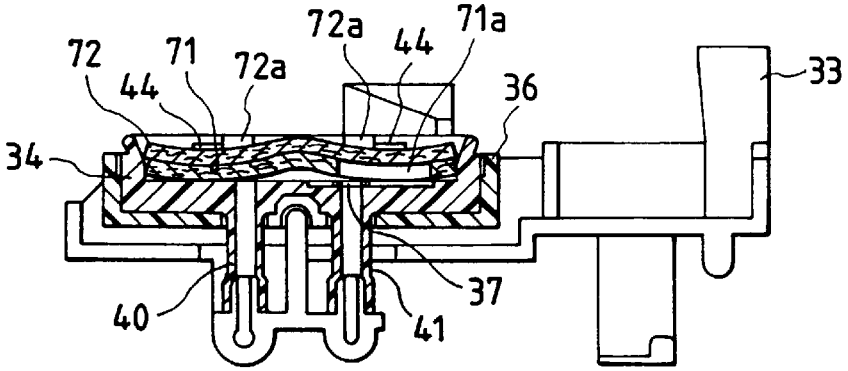

FIGS. 11(*a*) and (*b*) show a second embodiment of a capping device, where the reference numerals 71 and 72 represent a first ink absorbing sheet disposed on the lower layer side of the support frame 36, and a second ink absorbing sheet disposed on the upper layer side, and the both sheets are formed by cutting porous sheet material such as sponge or the like into almost the same shape as that of the inside space of the support frame 36.

The small hole diameter of the first ink absorbing sheet 71 is 75 μm or less and the small hole diameter of the second ink absorbing sheet 72 is 360 μm, and the porous material of the first material is softer than that of the second ink absorbing sheet 72. Therefore, the ink holding performance of the first ink absorbing sheet 71 is established to be larger than that of the second ink absorbing sheet 72.

A long hole 71*a* is formed in the first ink absorbing sheet 71 at an region opposite to an atmosphere communication hole 37 of the support frame 36, and side pieces 72*a* are provided in the second ink absorbing sheet 72. The side pieces 72*d* are bent upward to contact with side portions of projection pieces 44 when the side pieces 72*a* are accommodated in the support frame 36. The reference numeral 72*b* represents a convex piece for engaging with the projection pieces 44 formed in the inner circumferential side portions of the cap 34 in order to prevent rising.

Figure 12A:
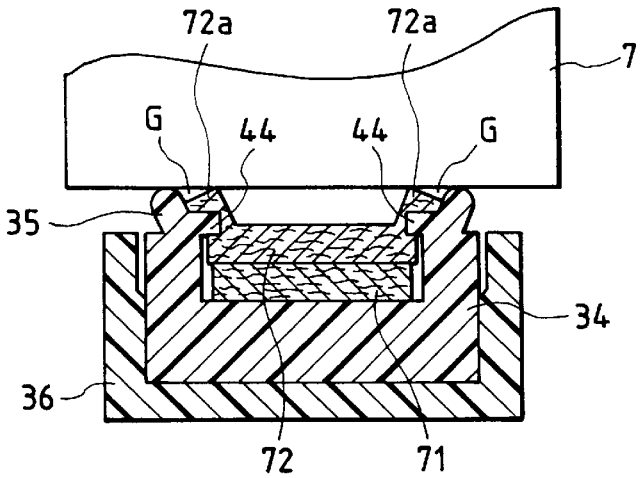
FIG. 12(*a*) is a sectional view illustrating the state where the capping device seals a recording head, FIG. 12(*b*) is an enlarged sectional view of FIG. 12(*a*) in the state where the ink is not gathering and FIG. 12(*c*) is an enlarged sectional view of FIG. 12(*a*) in the state where the ink is gathering.
Figure 12B:
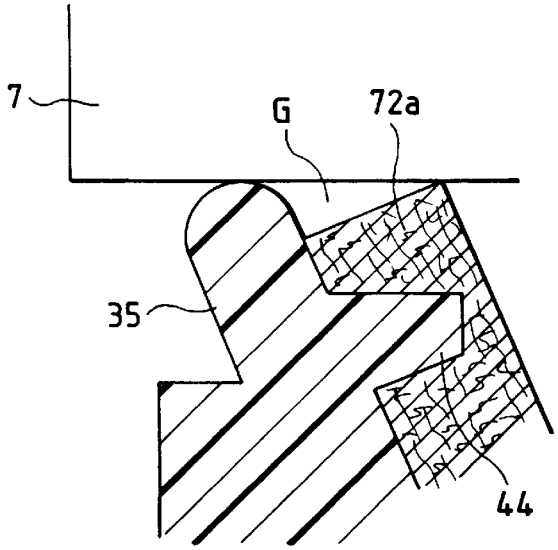
Figure 12C:
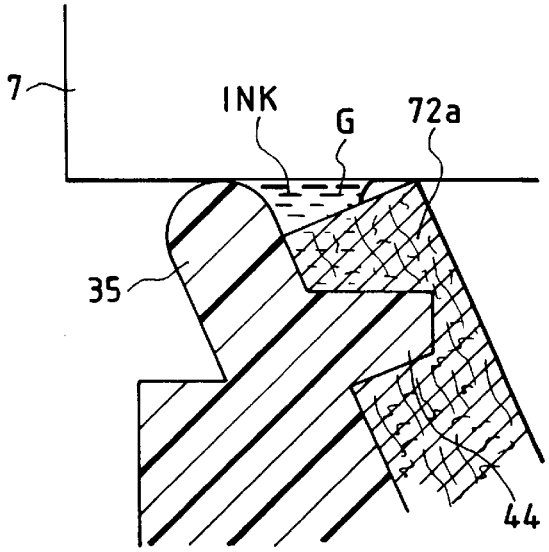
Figure 13:
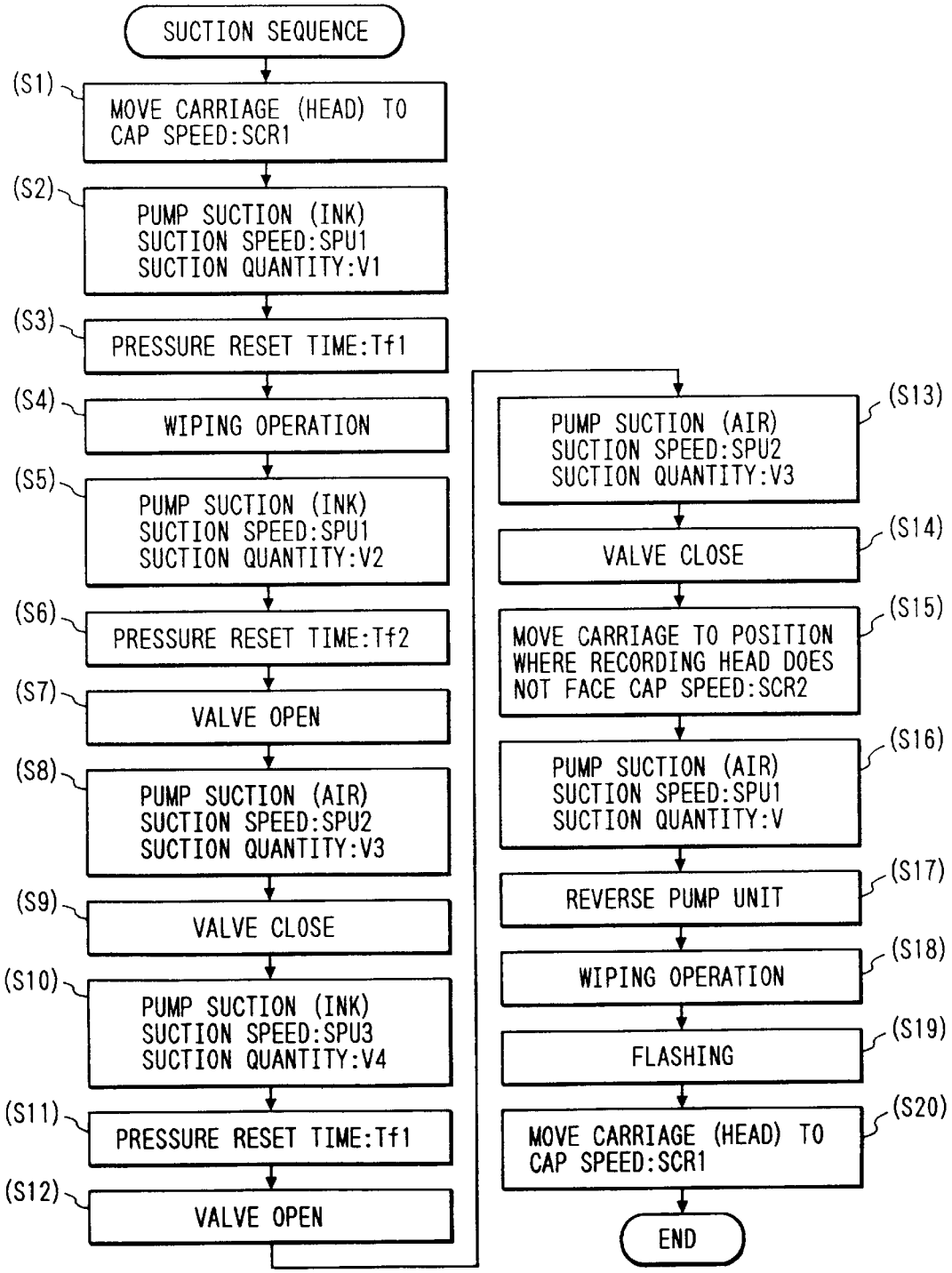
FIG. 13 is a flow chart illustrating a suction operation suitable for the capping device according to the second embodiment.

If there arises necessity to forcibly discharge ink from the recording head 7 in this embodiment, the carriage 1 is moved to a capping position in a predetermined speed SCR1 (FIG. 13, S1) so as to perform capping (FIGS. 9(*a*) and 9(*b*)), and actuate the pump unit 11 to operate. At this time, the pump unit 11 is controlled so that the suction speed is SPU1, and the suction quantity per unit time is V1 (FIG. 13, S2). Consequently, negative pressure is given into the cap 34 through an ink suction hole 38, so that part of ink ejected from nozzle openings gathers by the capillarity of narrow gaps G (FIG. 12(*a*)) formed by the projection pieces 44 for restricting the ink absorbing sheets 71 and 72 and the nozzle plate. Hereupon, FIG. 12(*b*) shows the state where the ink is not gathering and FIG. 12(*c*) shows the state where the ink is gathering. If the gathering ink is further increased, the ink stays all over the circumference in the cap 34 along a draping 35 of the cap 34.

However, since the side pieces 72*a* of the second ink absorbing sheet 72 are disposed at G, the ink is absorbed in the second ink absorbing sheet 72 by the capillarity of the side pieces 72*a,* so that the ink can be prevented surely from spreading to the nozzle plate through the draping 35 of the cap 34.

At the stage where the ink has been forcibly discharge, when the carriage 1 is further moved from the capping state toward the non-printing region (FIGS. 10(*a*) and 10(*b*)), the actuating rod 64 contacts with the stopper 33 to be pushed into the left in the drawing, so that the valve body 65 is separated from the valve seat 62. In such a manner, the pressure of the cap 34 is reset to the atmospheric pressure in time Tf1 gradually with a pressure change small enough so as not to such the air into the recording head (FIG. 13, S3).

Next, the carriage 1 is moved toward the printing region, and wiping is performed with a cleaning member to eliminate ink adhering to the nozzle plate (FIG. 13, S4).

At the stage where the wiping is completed, the carriage 1 is moved to the capping position again in the same manner as mentioned above to perform capping (FIGS. 9(*a*) and 9(*b*)) so as to actuate the pump unit 11 to operate. At this time, the suction is performed in the suction speed SPU1 and in the suction quantity V2 which is larger than the previous suction quantity V1 (FIG. 13, S5), so that the print failure is recovered.

At the stage where the recovery of the print failure is completed, the pressure of the cap 34 is reset to the atmospheric pressure gradually in time Tf2 longer than the previous time so as not to break the meniscus of the nozzle openings (FIG. 13, S6).

At the stage where the ink has been forcibly ejected, the carriage 1 is further moved from the capping state (FIGS. 9(*a*) and 9(*b*)) toward the non-printing region (FIGS. 10(*a*) and 10(*b*)), the actuating rod 64 contacts with the stopper 33 to be pushed in to the left in the drawing, so that the valve body 65 is separated from the valve seat 62 and the valve communicates with the air entirely (FIG. 13, S7).

In this state, the pump unit 11 is operated at a suction speed SPU2 lower than that in ink suction to suck ink by a predetermined quantity V3 (FIG. 13, S8). Consequently, the ink absorbed in the ink absorbing sheets 71 and 72 is sucked by the pump unit 11 while the air flows in from the atmosphere communication hole 37.

In this embodiment, the atmosphere communication hole 37 is exposed to the region of the first ink absorbing sheet 71 disposed in the bottom and opposite to the communication hole 37. The long hole 71*a* has an opening region larger than the communication hole 37. The surface of the long hole is sealed with the second ink absorbing sheet 72. Accordingly, the air flowing in through the atmosphere communication hole 37 is dispersed on a large scale in the opening region of the long hole 71*a,* and passes the second ink absorbing sheet 72 at a low flow speed. Therefore, the air can flow into the space of the cap 34 so as to restrain bubbling of the ink absorbed in the second ink absorbing sheet 72 as much as possible.

Next, the carriage 1 is moved to the capping position again, closing the valve to break off the communication between the cap 34 and the air (FIG. 13, S9), and the pump unit 11 is operated at the crawling speed SPU3 to suck ink by a small suction quantity V4 (FIG. 13, S10).

Next, the pressure of the cap 34 is reset to the atmospheric pressure in the time Tf1 (FIG. 13, S11). And the carriage is further moved from the capping state (FIGS. 9(*a*) and 9(*b*)) toward the non-printing region (FIGS. 10(*a*) and 10(*b*)) to open the valve (FIG. 13, S12) so that the ink of the ink absorbing sheets 71 and 72 is sucked at the suction speed SPU2 up to the suction quantity of about V3 in the same manner as mentioned above (FIG. 13, S13). At the stage where the suction operation is completed, the carriage 1 is moved toward the non-printing region to close the valve (FIG. 13, S14), and next, the carriage 1 is moved to the position where the recording head 7 does not face the cap 34 (FIG. 13, S15).

In such a manner, in the state where the upper surface of the cap 34 is opened, the pump unit 11 is operated at the suction speed SPU1 so that the suction is executed up to suction quantity V5 (FIG. 13, S16). Next, the pump unit 11 is slightly reversed to make communicated with the atomosphere (FIG. 13, S17), the carriage 1 is moved so that wiping is executed by the cleaning member (FIG. 13, S18), and after the carriage 1 is further moved to the position opposite to the cap 34, ink drops are ejected from the nozzle openings toward the cap 34 in response to an artificial printing signal (FIG. 13, S19).

At the stage where printing can be performed in such a manner, printing is executed when a printing signal is supplied, and the carriage 1 moves at a speed SCR1 and stands-by in the capping state when a printing signal is not supplied (FIG. 13, S20).

Figure 14A:
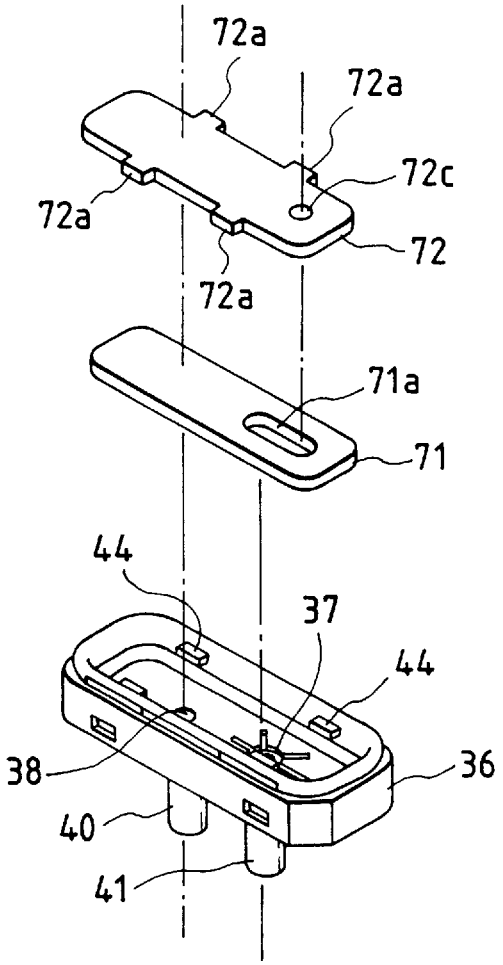
FIGS. 14(*a*) and 14(*b*) are an assembly perspective view and a sectional view of a capping device according to a third embodiment.
Figure 14B:
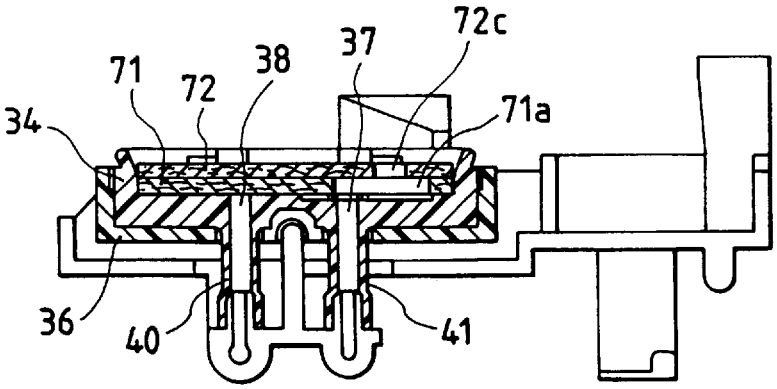

FIGS. 14(*a*) and 14(*b*) show a third embodiment of a capping device. In this embodiment, a through hole 72*c* is formed in the second ink absorbing sheet 72 at a position where the through hole 72*b* is not opposite to the atmosphere communication hole and to the nozzle openings, so that the air is discharged from the through hole 72*c* of the second ink absorbing sheet 72 while the air flowing in through the atmosphere communication hole 37 is dispersed from the long hole 71*a* of the first ink absorbing sheet 71 to thereby make it possible to reduce the quantity of the air passing the second ink absorbing sheet 72 as much as possible so as to prevent the ink from bubbling.

Figure 15A:
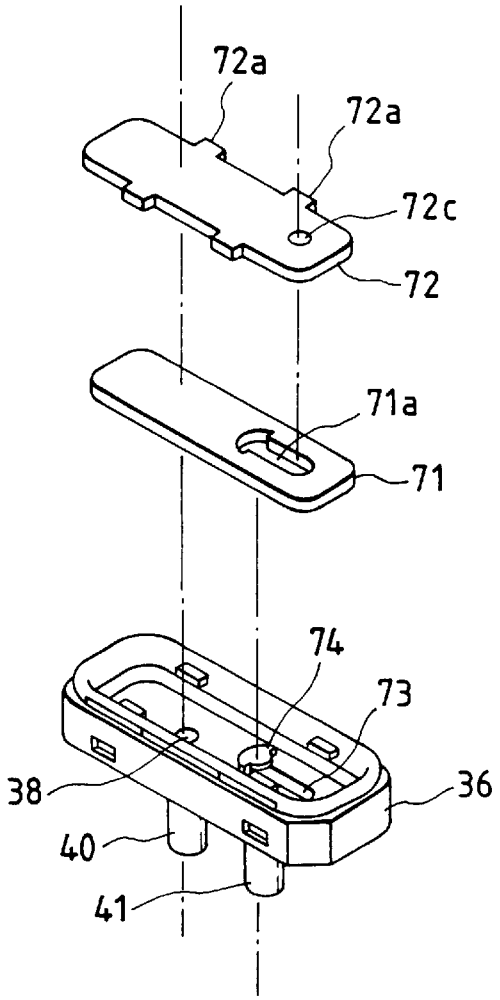
FIGS. 15(*a*) and 15(*b*) are an assembly perspective view and a sectional view of a capping device according to a fourth embodiment.
Figure 15B:
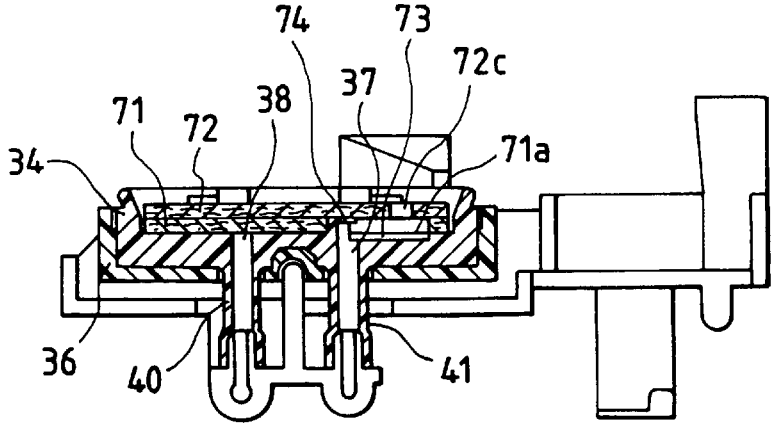

FIGS. 15(*a*) and (*b*) show a fourth embodiment of a capping device. The reference numeral 73 represents a long groove formed as a long hole extended in the longitudinal direction of the cap 34. A baffle plate 74 is provided at a position opposite to the atmosphere communication hole 37 of the conduit 41 so as to define a gap to an extent of the thickness of the first ink absorbing sheet 71.

On the other hand, a long hole 71*a* having almost the same shape as the long groove 73 is formed in the first ink absorbing sheet 71 disposed on the lower layer side. And the through hole 72*c* is formed as that of the third embodiment in the second ink sheet 72.

In this embodiment, when suction is performed by making atmosphere communication hole 37 communicate with the air, the air flowing in through the atmosphere communication hole 37 collide against the baffle plate 74 so as to be bent to the side, and dispersed into a wide space formed by the long groove 73 and the long hole 71*a* of the first ink absorbing sheet 71. Part of the air passes the through hole 72*c* of the second ink absorbing sheet 72, and the rest passes the second ink sheet 72 to be released to the space of the cap 34.

Figure 16A:
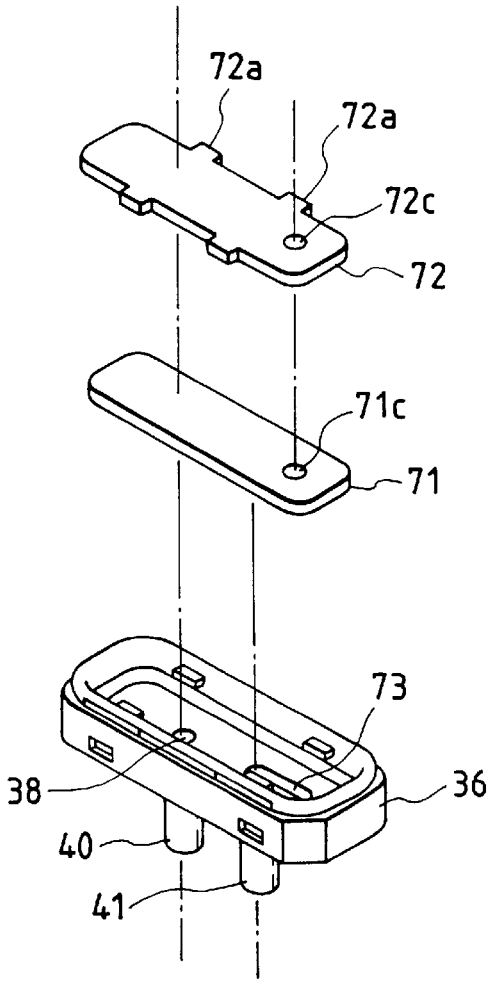
FIGS. 16(*a*) and 16(*b*) are an assembly perspective view and a sectional view of a capping device according to a fifth embodiment.
Figure 16B:
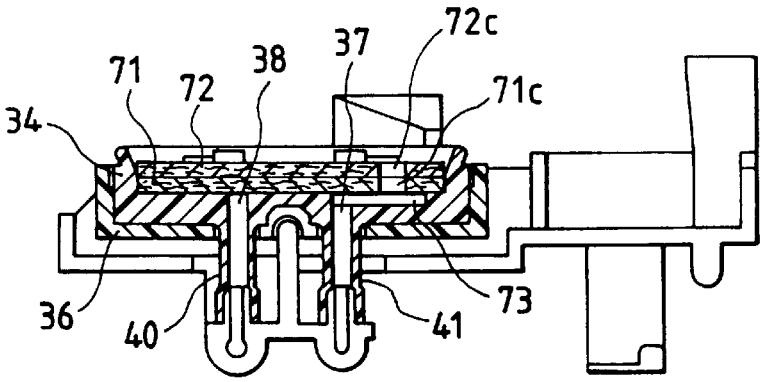

FIGS. 16(*a*) and 16(*b*) show a fifth embodiment of a capping device. In this embodiment, the first and second ink absorbing sheets 71 and 72 have through holes 71*c* and 72*c* separated from the position of the atmosphere communication hole 37 of the long groove 73 formed in the cap 34. Through holes 71*c,* 72*c* communicate with positions which are not opposite to the arrays of the nozzle openings of the recording head.

According to this embodiment, the air flowing in through the atmosphere communication hole 37 moves in the space of the long groove 73 by the functions of the long groove 73 and the first and second ink absorbing sheets 71 and 72 closing the long groove 73, so that the air flows into the cap space from places other than the arrays of the nozzle openings substantially without passing the first and second ink absorbing sheets 71 and 72. Consequently, the ink of the ink absorbing sheets can be sucked while the ink of the ink absorbing sheets is prevented from bubbling as much as possible.

Figure 17A:
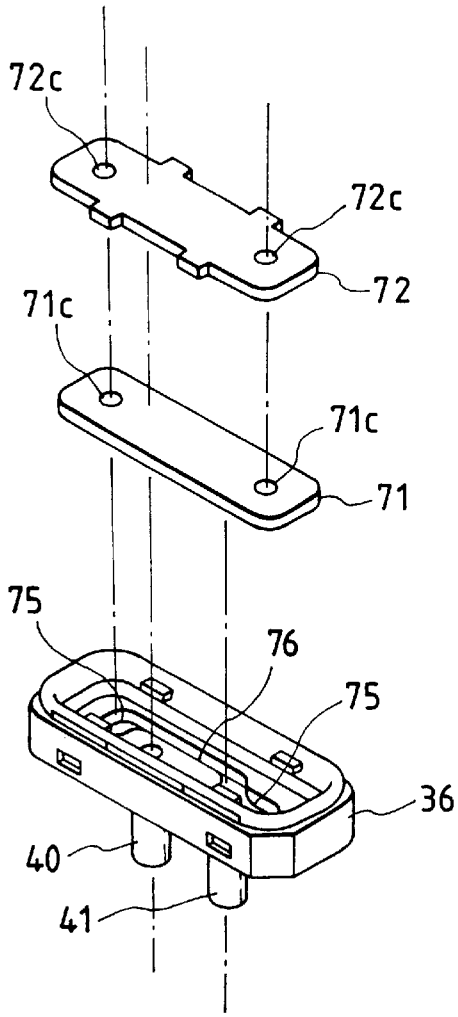
FIGS. 17(*a*) and 17(*b*) are an assembly perspective view and a sectional view of a capping device according to a sixth embodiment.
Figure 17B:
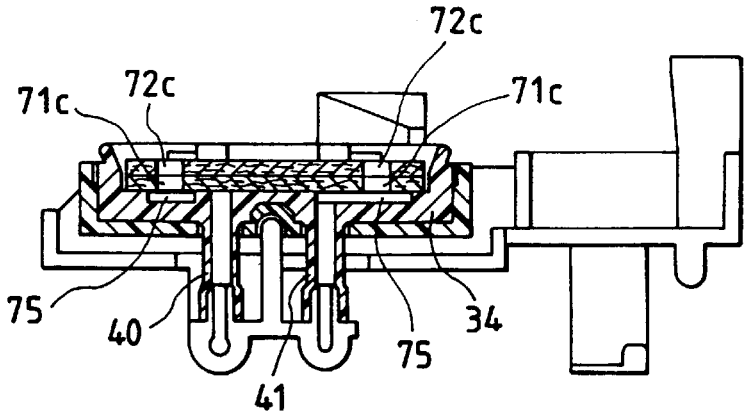

Although only one through hole 71*c*, 72*c* as the flowing entrance of the air is provided in the first and second ink absorbing sheets 71 and 72 respectively in the fifth embodiment, the air blowing-out region can be widened if the through holes 71*c* and 72*c* are formed on the both sides of the ink absorbing sheets 71 and 72 as shown in FIGS. 17(*a*) and 17(*b*) and concave portions 75 are formed in the positions of the cap 34 opposite to these through holes 71*c*, 72*c* so as to communicate with the atmosphere communication hole 37 through a connection groove 76.

Figure 18A:
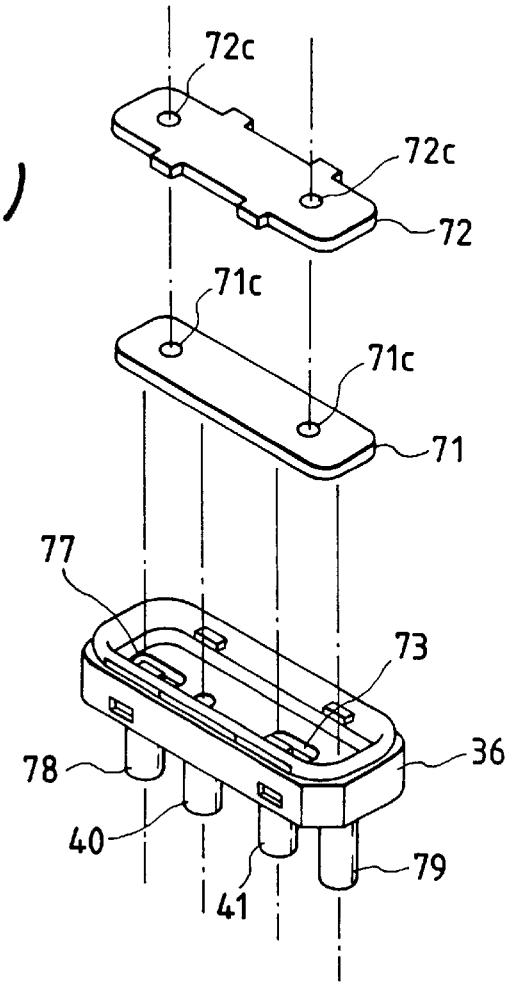
FIGS. 18(*a*) and 18(*b*) are an assembly perspective view and a sectional view of a capping device according to a seventh embodiment.
Figure 18B:
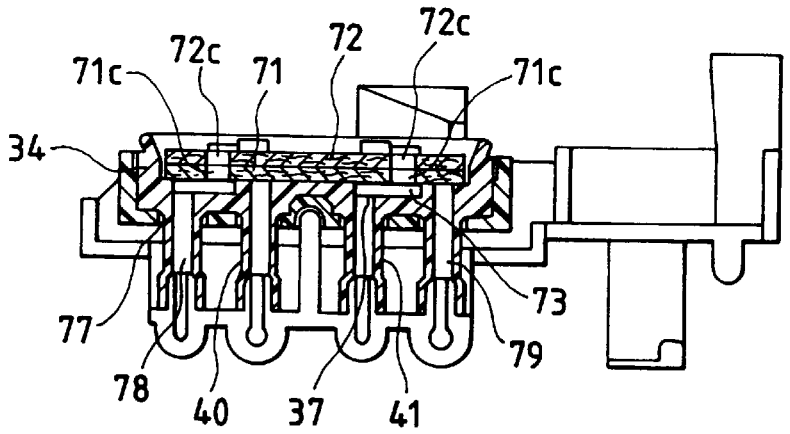

The concave portions 75 are made to communicate with one atmosphere communication hole 37 through the connection groove 76 in the sixth embodiment. However, in a seventh embodiment shown in FIGS. 18(*a*) and 18(*b*), respective concave portions 75 is connected not only to the valve unit 23 through independent conduits 41 and 78 respectively, but also to the pump unit 11 through another conduit 79.

When respective suction holes are made independent in such a manner, blowing out of the air from the connection groove 76 (FIGS. 17(*a*) and 17(*b*)) can be prevented, so that bubbles can be prevented from being produced surely, and ink is sucked in a plurality of places, so that it is possible to surely suck the ink of the ink absorbing sheets 71 and 72 by a small absorbing force, and it is possible to surely prevent bubbles from being produced.

Figure 19A:
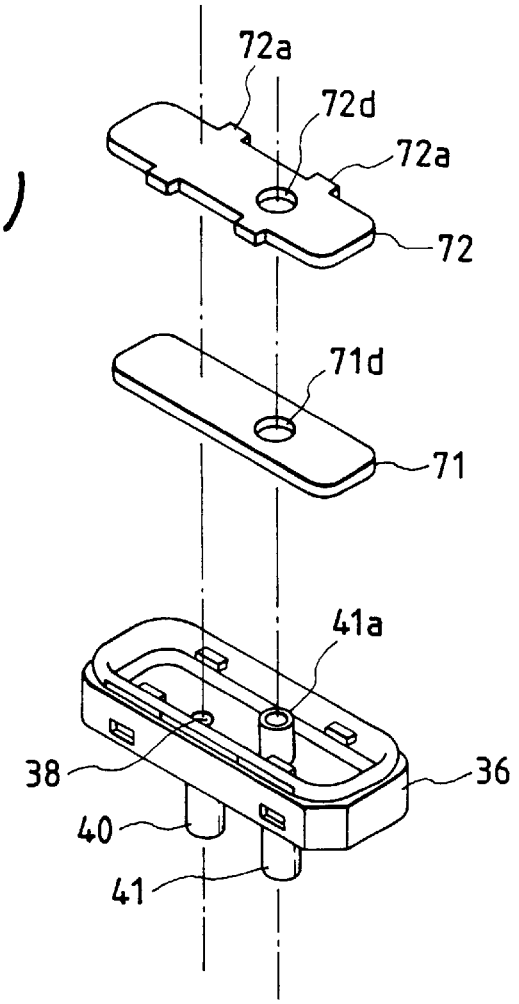
FIGS. 19(*a*) and 19(*b*) are an assembly perspective view and a sectional view of a capping device according to an eighth embodiment.
Figure 19B:
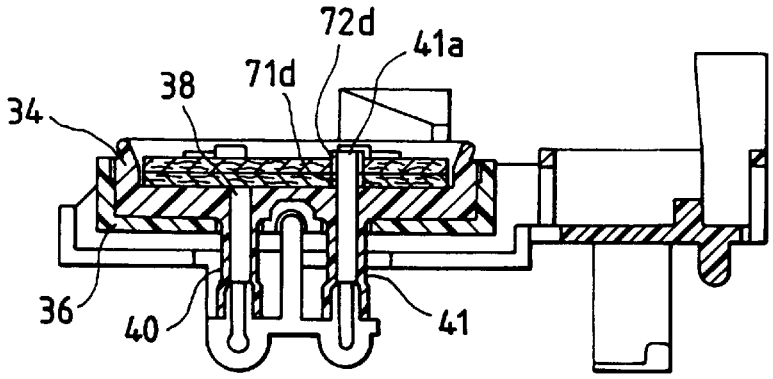

FIGS. 19(*a*) and 19(*b*) show an eighth embodiment of a capping device. Although the air is made to flow into the cap 34 through the second ink absorbing sheet 72 or through the through holes of the ink absorbing sheets 71 and 72 in the above embodiments. The conduit 41 connected to the atmosphere communication hole of the cap 34 may be provided in a position which is not opposite to the arrays of the nozzle openings of the recording head and a top end 41*a* of the conduit 41 is made to penetrate the ink absorbing sheets 71 and 72 so as to expand up to be high enough not to contact with the recording head in the eighth embodiment. Further, penetration holes 71*d* and 72*d* may be formed in the respective ink absorbing sheets 71 and 72 which are accommodated in the cap 34.

According to this embodiment, the air flowing in at the time of air suction is received in a region other than the nozzle-opening region of the recording head without contacting with the ink absorbing sheets 71 and 72. Accordingly, bubbling can be surely prevented from occurring.

Figure 20A:
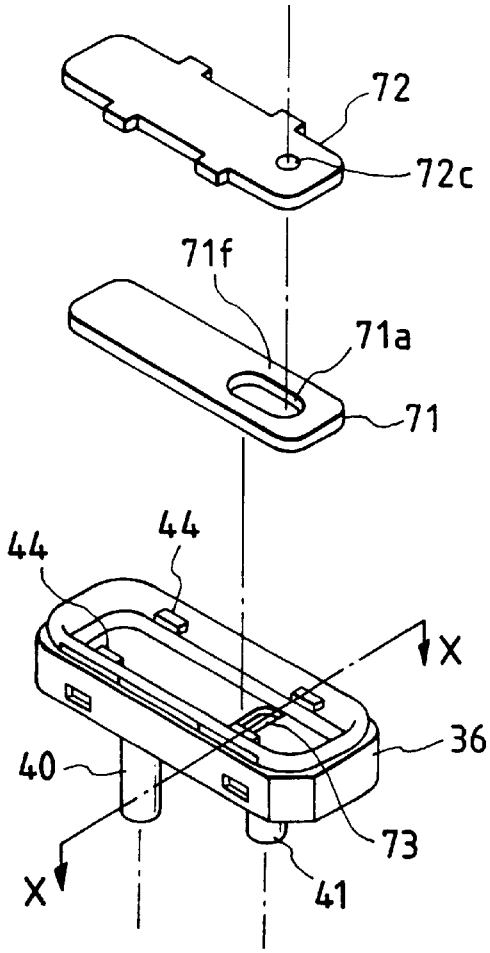
FIGS. 20(*a*) and 20(*b*) are an assembly perspective view and a sectional view of a capping device according to a ninth embodiment.
Figure 20B:
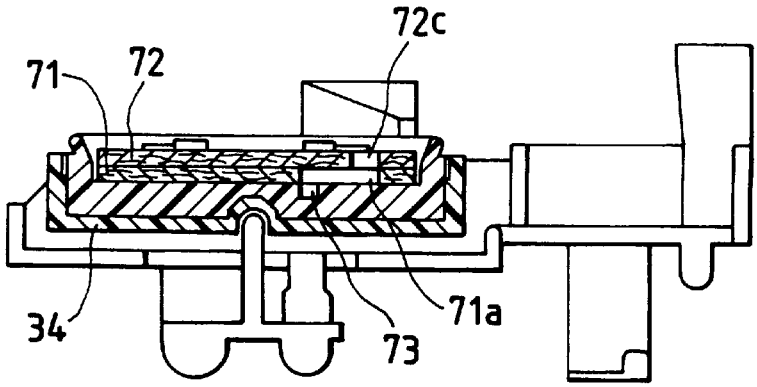
Figure 21A:
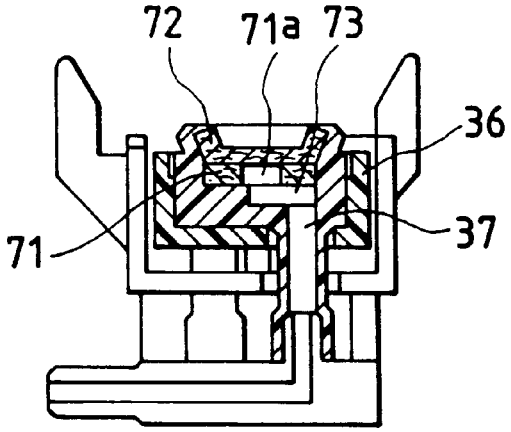
FIGS. 21(*a*) and 21(*b*) are a sectional structure view taken along line X—X in FIG. 20(*a*) and a top structure view of the capping device according to the ninth embodiment.
Figure 21B:
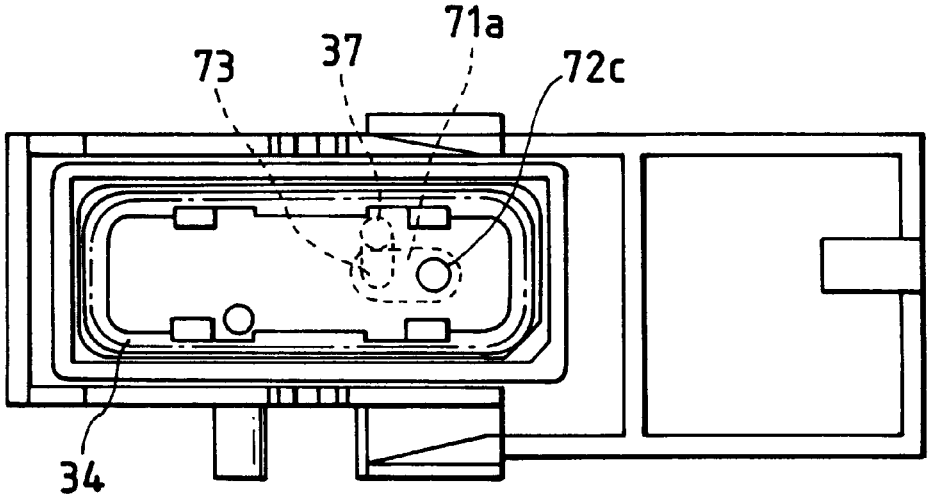

FIGS. 20(*a*) to 20(*d*) show a ninth embodiment of a capping device. In this embodiment, the atmosphere communication hole 37 of the cap 34 is provided so as to be one-sided to contact with the surface of an inner wall of the cap 34 extended in the longitudinal direction, and a long groove 73 is formed so as to extend from here to the center portion.

On the other hand, the first ink absorbing sheet 71 has a long hole 71*a* which is not opposite to the atmosphere communication hole 37 and communicates with the long groove 73, and the second ink absorbing sheet 72 has a through hole 72*c* in the position which is not opposite to the long groove 73 and communicates with the long hole 71*a*.

In this embodiment, the air flowing in through the atmosphere communication hole 37 is guided into the long hole 71*a* of the first ink absorbing sheet 71 through the long groove 73 of the cap bottom portion so as to be dispersed, and flows into the cap 34 through the through hole 72*c* of the second ink absorbing sheet 72.

In this flowing process, since a side portion 71*f* of the first ink absorbing sheet 71 is opposite to the upper of the atmosphere communication hole 37 at a gap corresponding to the depth of the long groove 73, the air blowing out of the atmosphere communication hole 37 is guided by the long groove 73 so as to move to the center without blowing out along the inner wall of the cap 34 and then blown out of the through hole 72*b* disposed on the center line through an L-shaped passage formed by the long groove 73 and the long hole 71*a*.

Consequently, even in the case where it is inevitable to provide the atmosphere communication hole 37 so as to be one-sided to one side wall of the cap 34, it is possible to surely prevent bubbling from being produced in the position near the inner wall of the cap 34. Accordingly, ink bubbles which are difficult to be eliminated can be prevented from adhering to the edge of the cap 34.

As has been described above, according to the invention, there is provided a capping device for an ink jet recording head, comprising: a base; an arm swingably and slidably supported by the base; a slider which is swingably connected to the arm, the slider approaching and separating from the recording head while moving up and down; a cap disposed on the slider; and an elastic member which urges the cap for the recording head side in such a manner that only one corner of the cap projects for the recording head at the time of non-capping. Accordingly, the cap comes into contact with the recording head so as to expand the contact region gradually from its one corner, and the cap performs capping so as to be familiar with the recording head from its one corner, so that the cap can contact with the recording head tightly with a small pressure and nozzle openings can be surely sealed even if the recording head has a large aspect ratio.

What is claimed is:

1. A capping device for an ink jet recording head, comprising:

a base;

an arm swingably and slidably supported by said base;

a slider which is swingably connected to said arm, said slider approaching and separating from the recording head while moving up and down;

a cap disposed on said slider for capping the recording head; and an elastic member positioning said cap at a slant with respect to said recording head so that only one corner of said cap projects toward the recording head when said cap is not capping said recording head.

2. The capping device for an ink jet recording head according to claim 1, wherein:

said elastic member comprises a spring and a first conduit:

said capping device further comprises a second conduit;

said cap further comprises an atmosphere communication hole and an ink suction hole;

said first conduit extends from said atmosphere communication hole;

said second conduit extends from said ink suction hole;

said spring is disposed between said slider and said cap so as to slant said cap with respect to said recording head.

3. The capping device for an ink jet recording head according to claim 2, wherein said first conduit is longer than said second conduit.

4. The capping device for an ink jet recording head according to claim 2, wherein said spring is interposed between said slider and said cap at an offset to one side from a center line of said cap so that only one corner of said cap projects toward the recording head when said cap is not capping said recording head.

5. The capping device for an ink jet recording head according to claim 2, wherein said first and second conduits are positioned on a center line parallel to the longitudinal direction of said cap.

6. The capping device for an ink jet recording head according to claim 2, wherein said first and second conduits are positioned adjacent to a center line of a longitudinal width of said cap.

7. The capping device for an ink jet recording head according to claim 2, wherein said cap is integrally formed with said first and second conduits.

8. The capping device for an ink jet recording head according to claim 2, wherein said slider is pressed by the recording head or a carriage holding the recording head so as to follow the carriage while moving up and down.

9. The capping device for an ink jet recording head according to claim 1, further comprising:

a projection rod extended out of said base, a recessed portion formed in said cap, said cap being fitted to a top of said projection rod except when said cap is not capping said recording head.

10. The capping device for an ink jet recording head according to claim 1, wherein said elastic member comprises a spring interposed between said slider and said cap.

11. A capping device for an ink jet recording head, comprising:

a cap for capping a recording head; and a rectangular draping having round corners formed at a circumferential edge of an opening portion of said cap, wherein a maximum length of a linear region of a center portion of a short side of said draping is substantially equal to a radius of the round corners.

12. The capping device for an ink jet recording head according to claim 11, wherein a center region of a long side of said draping is thicker in a width direction thereof than a corner portion.

13. A capping device for an ink jet recording head, comprising:

a cap for capping a recording head, said cap including an atmosphere communication hole which communicates with an atmosphere through a valve, an ink suction hole which communicates with a pump unit, and a groove formed in a circumferential edge of said atmosphere communication hole; and an ink absorbing sheet covering said ink suction hole, said ink absorbing sheet being made of a porous material and being disposed in said cap.

14. The capping device for an ink jet recording head according to claim 13, wherein said cap further comprises: an ink-nontransmissible mask having a window in a region opposite to an array of nozzle openings of the recording head and being disposed on said first ink absorbing sheet.

15. The capping device for an ink jet recording head according to claim 13, further comprising:

a second ink absorbing sheet laminated on said first ink absorbing sheet, said first ink absorbing sheet and said second ink absorbing sheet each including a small hole formed therein, wherein the small hole of said first ink absorbing sheet has a diameter which is smaller than that of the small hole of said second ink absorbing sheet and said first ink absorbing sheet is more flexible than said second ink absorbing sheet.

16. The capping device for an ink jet recording head according to claim 15, wherein a plurality of projection pieces for engaging said second ink absorbing sheet are formed on an inner circumferential side of said cap, and said second ink absorbing sheet includes a plurality of side pieces for contacting said projection pieces.

17. The capping device for an ink jet recording head according to claim 15, wherein said first ink absorbing sheet has a long hole in a region opposite to the atmosphere communication hole, and said second ink absorbing sheet has a through hole in a region not opposite to the atmosphere communication hole and opposite to the long hole.

18. The capping device for an ink jet recording head according to claim 15, wherein said first ink absorbing sheet has a long hole in a region of opposite to the atmosphere communication hole, said second ink absorbing sheet has a through hole formed in a region not opposite to the atmosphere communication hole but opposite to the long hole, and a baffle board is disposed at a position which is in an upper of the atmosphere communication hole and in contact with a bottom of said second ink absorbing sheet.

19. The capping device for an ink jet recording head according to claim 15, wherein said cap has a long groove which is connected to the atmosphere communication hole and formed at the bottom thereof, said first ink absorbing sheet has a first through hole formed in a region not opposite to the atmosphere communication hole and opposite to the long groove, and said second ink absorbing sheet has a second through hole formed in a region opposite to the first through hole.

20. The capping device for an ink jet recording head according to claim 15, wherein said cap has a first concave portion formed at a position surrounding the atmosphere communication hole, a connection groove connected to the first concave portion and a second concave portion connected to the connection groove all formed at the bottom of said cap, and said first ink absorbing sheet has a plurality of through holes in a region not opposite to the atmosphere communication hole and opposite to said first and second concave portion, and said second ink absorbing sheet has a plurality of through holes communicating with the through holes of said first ink absorbing sheet.

21. The capping device for an ink jet recording head according to claim 5, wherein said cap has first and second concave portions formed at different positions at the bottom thereof and a conduit connecting the first and second concave portions to the pump unit, said first ink absorbing sheet has a plurality of through holes in a region not opposite to the atmosphere communication hole and opposite to the first and second long concave portions, and said second ink absorbing sheet has a plurality of through holes communicating with the through holes of said first ink absorbing sheet.

22. The capping device for an ink jet recording head according to claim 21, wherein said cap has a second ink suction hole formed at the bottom thereof.

23. The capping device for an ink jet recording head according to claim 15, wherein the atmosphere communication hole is extended through said first and second ink absorbing sheets to the upper portion of said cap so as not to contact with the recording head.

24. The capping device for an ink jet recording head according to claim 15, wherein the small hole diameter of said first ink absorbing sheet is 50 to 150 $\mu$m, and the small hole diameter of said second ink absorbing sheet is 200 to 400 $\mu$m.

25. The capping device for an ink jet recording head according to claim 13, wherein said first ink absorbing sheet has a long hole in a region opposite to the atmosphere communication hole.

* * * * *